US007115051B2

(12) United States Patent
Hansberry

(10) Patent No.: US 7,115,051 B2
(45) Date of Patent: Oct. 3, 2006

(54) PRACTICE EQUIPMENT

(75) Inventor: Joseph P. Hansberry, 35 Harrison St., Framingham, MA (US) 01702

(73) Assignee: Joseph P. Hansberry, Framingham, MA (US)

( * ) Notice: Subject to any disclaimer, the term of this patent is extended or adjusted under 35 U.S.C. 154(b) by 0 days.

(21) Appl. No.: 10/388,199

(22) Filed: Mar. 13, 2003

(65) Prior Publication Data

US 2003/0224880 A1 Dec. 4, 2003

Related U.S. Application Data

(63) Continuation-in-part of application No. 09/206,460, filed on Dec. 7, 1998, now abandoned.

(60) Provisional application No. 60/067,988, filed on Dec. 9, 1997.

(51) Int. Cl.
*A63B 69/00* (2006.01)

(52) U.S. Cl. ..... 473/423; 473/422; 473/430; 119/708

(58) Field of Classification Search ..... 473/422–431, 473/506–508, 569, 578; 273/317.8, 331, 273/334, 335, 348; 119/708
See application file for complete search history.

(56) References Cited

U.S. PATENT DOCUMENTS

| | | | | | |
|---|---|---|---|---|---|
| 773,167 | A | | 10/1904 | Spink | |
| 1,230,169 | A | * | 6/1917 | Johnson | 188/65.4 |
| 1,603,610 | A | * | 10/1926 | Korth | 482/87 |
| 1,693,180 | A | * | 11/1928 | Phelp | 47/43 |
| 1,726,554 | A | | 9/1929 | Gagnon | |
| 1,818,301 | A | | 8/1931 | Canaday | |
| D97,721 | S | | 12/1935 | Stam | |
| 2,360,173 | A | | 10/1944 | Tanger | |
| 2,484,475 | A | | 10/1949 | Studer | |
| 3,166,316 | A | | 1/1965 | O'Leary | |
| 3,194,557 | A | * | 7/1965 | Holley | 473/430 |
| 3,593,998 | A | * | 7/1971 | Pattyn | 473/430 |
| 3,776,551 | A | | 12/1973 | Schaller et al. | |
| 4,114,553 | A | * | 9/1978 | Zidek | 114/230.29 |
| 4,185,821 | A | | 1/1980 | Piccini | |
| 4,191,372 | A | * | 3/1980 | Keller | 473/418 |
| 4,414,712 | A | * | 11/1983 | Beggins | 24/129 R |
| 4,462,599 | A | * | 7/1984 | Brown | 473/430 |
| 4,502,684 | A | * | 3/1985 | Rocha | 473/429 |
| 4,576,379 | A | * | 3/1986 | Juhasz | 473/430 |
| 4,634,116 | A | | 1/1987 | Amador et al. | |
| 4,647,042 | A | * | 3/1987 | Bruce | 473/430 |
| 4,674,744 | A | * | 6/1987 | Walsh | 473/430 |
| 4,712,510 | A | | 12/1987 | Tae-Ho | |
| 4,870,776 | A | * | 10/1989 | Schock | 43/42.3 |
| 4,940,018 | A | | 7/1990 | Edling | |

(Continued)

FOREIGN PATENT DOCUMENTS

GB 2042904 A * 10/1980

(Continued)

OTHER PUBLICATIONS

'Schutt STKRBII Striker-II, Portable Training Device' [online]. Sep. 2, 2004, Retrieved from the internet: http://www.anacondasports.com/webapp/wcs/stores/servlet/ProductDisplay?catalogId=10551&storeId=10201&categoryId=50741&langId=-1&sportId=49301&productId=111540 (date unknown).

*Primary Examiner*—Mitra Aryanpour
(74) *Attorney, Agent, or Firm*—Nutter, McClennen & Fish, LLP

(57) ABSTRACT

A training device can be used, for example, to practice punching and kicking techniques and to practice baseball batting and golf swing mechanics.

28 Claims, 12 Drawing Sheets

U.S. PATENT DOCUMENTS

| | | | | | |
|---|---|---|---|---|---|
| 4,989,865 | A | | 2/1991 | Plevier | |
| 5,022,345 | A | * | 6/1991 | Bolivar et al. | 119/708 |
| 5,092,272 | A | | 3/1992 | O'Rourke | |
| 5,111,771 | A | | 5/1992 | Mathews | |
| 5,230,650 | A | | 7/1993 | Brayton | |
| 5,282,615 | A | * | 2/1994 | Green et al. | 473/418 |
| 5,386,986 | A | * | 2/1995 | Gamboa | 473/430 |
| 5,467,740 | A | | 11/1995 | Redwine | |
| 5,467,978 | A | * | 11/1995 | Paluch | 473/429 |
| 5,624,358 | A | | 4/1997 | Hestilow | |
| 5,713,805 | A | * | 2/1998 | Scher et al. | 473/426 |
| 5,755,184 | A | | 5/1998 | Neidenberger | |
| 5,795,251 | A | * | 8/1998 | Andersen | 473/427 |
| 5,813,931 | A | | 9/1998 | Gormley | |
| 6,099,419 | A | * | 8/2000 | Incaudo et al. | 473/429 |
| 6,290,618 | B1 | * | 9/2001 | Ring | 473/429 |
| 6,482,112 | B1 | * | 11/2002 | Betz | 473/421 |
| 6,575,119 | B1 | * | 6/2003 | Lonsway | 119/708 |
| 6,669,152 | B1 | * | 12/2003 | Hernandez | 248/165 |
| 6,705,960 | B1 | * | 3/2004 | Gormley | 473/417 |
| 2004/0107917 | A1 | * | 6/2004 | Gerlach | 119/708 |

FOREIGN PATENT DOCUMENTS

| | | | | |
|---|---|---|---|---|
| GB | 2098061 | A | * | 11/1982 |
| GB | 2341327 | A | * | 3/2000 |
| JP | 07241361 | A | * | 9/1995 |

* cited by examiner

PRACTICE EQUIPMENT

CROSS-REFERENCE TO RELATED APPLICATION

This is a continuation-in-part of U.S. patent application Ser. No. 09/206,460, filed Dec. 7, 1998, now abandoned which claims priority to and the benefit of U.S. patent application Ser. No. 60/067,988, filed Dec. 9, 1997, the entire disclosure of each of which is incorporated by reference herein.

TECHNICAL FIELD

The invention relates to practice equipment. More particularly, the invention relates to equipment that can be used by a user to improve the user's hand-eye coordination.

BACKGROUND INFORMATION

Certain devices exist that are designed to improve hand-eye coordination. Some of these devices are geared to toddlers as tools for developing motor skills. Other such devices are directed to athletes. World-class boxers regularly use speed bags as part of their athletic training. Devices to improve hand-eye coordination also can be used for physical or occupational therapy applications. For example, specialists often use devices to aid stroke victims in re-learning or practicing their basic motor skills. Existing devices generally are cumbersome, heavy, difficult to assemble, and/or contain many parts that easily can be misplaced.

SUMMARY OF THE INVENTION

The invention generally relates to practice equipment that can be used by a user to improve the user's hand-eye coordination. The equipment allows a user to repeat various motions to develop certain motor skills by repetitive practice. The equipment is easily assembled, disassembled, and transported.

Practice equipment according to the invention includes a flexible line that can be secured to a hollow member by a user without requiring the user to employ any extra parts or tools. Also, a target can be coupled to the flexible line hanging down from the hollow member. Furthermore, the user can couple a target the flexible line hanging down from the hollow member and adjust the height of the target hanging down from the hollow member by manipulating the flexible line.

In general, in one aspect, the invention features a support structure for use with a flexible line. The support structure comprises a hollow member comprising a plurality of apertures which allow the flexible line to be passed into and out of the hollow member. The plurality of apertures are disposed along at least a portion of the length of the hollow member. The hollow member further comprises an end aperture at an end of the hollow member, and the end aperture allows the flexible line to be passed therethrough and hang down from the hollow member.

Embodiments according to this aspect of the invention can include the following features. The hollow member can further comprise an end cap that includes the end aperture and that is coupleable to the end of the hollow member. The end cap can be coupleable to the hollow member by a male/female connection. The hollow member can be cylindrical. The plurality of apertures can be disposed substantially diametrical along at least a portion of the length of the hollow member. The apertures can be disposed substantially linearly along at least a portion of the length of the hollow member.

In general, in another aspect, the invention features a system for improving a user's hand-eye coordination. The system comprises a hollow member comprising a plurality of apertures disposed along at least a portion of the length of the hollow member. The hollow member further comprises an end aperture at an end of the hollow member. The system also comprises a flexible line for passing into and out of the hollow member through at least some of the plurality of apertures. The flexible line also passes through the end aperture to allow the flexible line to hang down from the hollow member. The system also comprises a stand structure coupleable to the hollow member to support the hollow member at a height sufficient to dispose the flexible line at a location convenient for the user when the flexible line hangs down from the hollow member.

Embodiments according to this aspect of the invention can include the following features. The hollow member can further comprise an end cap that includes the end aperture and that is coupleable to the end of the hollow member. A portion of the flexible line can be frayed. The flexible line can be a rope, a cable, a string, a cord, or a wire. A target can be coupled to the flexible line, and the target can be a ball, and the ball can include a hole through which the flexible line passes. The target can move when struck by an object wielded by the user. The object can be a bat, a racket, or a club. The target also can move when struck directly by the user. A weight can be coupled to the flexible line, and the weight can keep the flexible line substantially taut when the flexible line hangs down from the hollow member in a resting position. The weight can comprise tape, rubber, plastic, metal, or wood. The weight can be a nut, a washer, or a ball bearing. The stand structure can comprise a plurality of separable members where at least one of the separable members is coupleable to the hollow member. The stand structure can be coupleable to the hollow member by a male/female connection. The system also can comprise a base that is coupleable to the stand structure by, for example, a male/female connection. The base can comprise a plurality of support members, and each of the members can be cylindrical. At least one of the support members can be coupleable to the stand by a male/female connection.

The foregoing and other objects, aspects, features, and advantages of the invention will become more apparent from the following description and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DESCRIPTION

The invention relates to a device for developing and/or improving the hand-eye coordination and motor skills of a user. The invention generally is applicable for use by children, adults, and even the elderly. Some embodiments of the invention also can be used by an animal. For example, a dog can be trained to hit a target hanging from a hollow member of the support structure.

The invention generally relates to a support structure for use with a flexible line. A flexible line preferably has sufficient tensile strength to avoid tangling with the hollow member when the flexible line rotates around the axis of the hollow member. Generally, flexible lines that have greater tensile strengths are less likely to tangle when struck. However, the tensile strength of a flexible line must be appropriate to allow the flexible line to hang down from the hollow member.

Figure 1A:
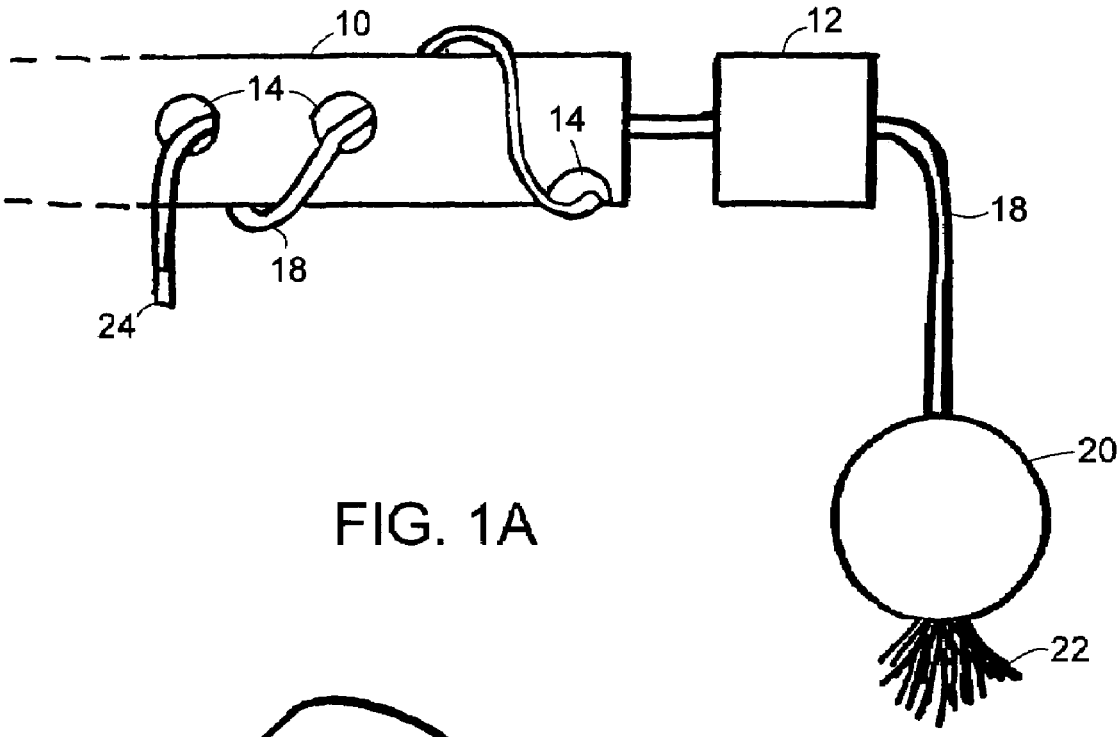
FIG. 1A is a side view of a support structure having a flexible line passing through a hollow member of the invention.

Referring to FIG. 1A, a flexible line 18 secures to a hollow member 10 without requiring extra parts or tools. The flexible line 18 can be made from one or more light weight materials, including, for example, a polyester, nylon, cotton, rubber, steel or other material. According to the invention, the flexible line 18 passes through the hollow member 10 and hangs therefrom. A flexible line 18 can be a rope, a cable, a string, a cord, a wire, or a combination of any of the above.

In the disclosed embodiment, referring to FIG. 1A, the hollow member 10 is coupleable to an end cap 12. The hollow member 10 and the end cap 12 can be coupled by a male/female connection, such as, an internal screw. However, the hollow member 10 and the end cap 12 can be coupled by any known coupling means including, for example, by an adhesive.

Also, referring to the disclosed embodiment shown in FIG. 1A, the hollow member 10 includes a plurality of apertures 14 disposed along a portion of the length of the hollow member 10. The disclosed embodiment shows a substantially circular apertures 14, however the apertures can be in any configuration including, for example, square, triangle or oval. The plurality of apertures 14 also can correspond to the diametric configuration of the flexible line 18. Also, the plurality of apertures 14 can be configured as slits or openings that remain substantially closed when a flexible line 18 is not passing therethrough. Furthermore, a hollow member 10 can include a combination of open apertures and substantially closed apertures (e.g., slits).

Figure 1B:
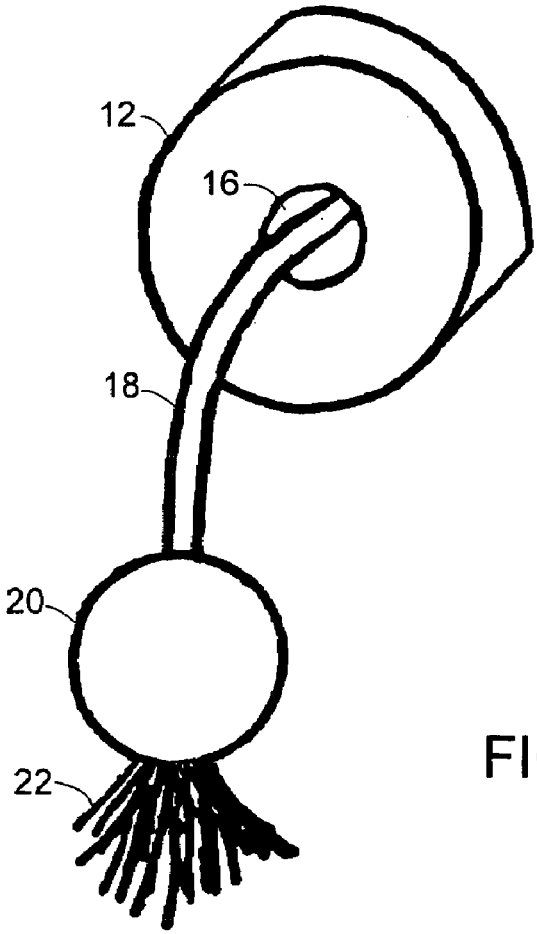
FIG. 1B is a partial end view of the support structure of FIG. 1A showing a flexible line passing through an end aperture of an end cap.

Also, as shown in the disclosed embodiment in FIG. 1B, the hollow member 10 further includes an end aperture 16 at an end of the end cap 12. However, the invention also can include an end aperture 16 at an end of the hollow member 10. The end cap 12 is coupleable to the hollow member 10 by a male/female connection.

Like the plurality of apertures 14 disposed on the hollow member 10, the end aperture 16 at the end of the hollow member 10 or the end cap 12 can be circular, oval, square or any other geometric shape. Furthermore, the end aperture 16 also can be substantially closed when a flexible line 18 is not passing therethrough (e.g., a slit that is substantially closed).

Also, as shown in FIGS. 1A and 1B, the flexible line 18 passes into and out of the hollow member 10 through the plurality of apertures 14 to allow the flexible line 18 to hang down from the hollow member 10. The flexible line 18 can pass through at least one of the plurality of apertures 14 disposed along at least a portion of the length of the hollow member 10. The flexible line 18 also can pass through each of the plurality of apertures 14 disposed along at least a portion of the length of the hollow member 10. The length of the flexible line 18 hanging down from the hollow member 10 is changed by adjusting the amount of the flexible line 18 that passes into and out of the hollow member 10.

The disclosed embodiment shows a hollow member 10 that is cylindrical, or substantially cylindrical. However, the hollow member 10 can be designed in other configurations that allow for a plurality of apertures 14 to be disposed thereon. The hollow member 10 can have an arcuate or curved configuration, for example. Also, the hollow member 10 can be an empty tubular member. However, the hollow member 10 also can be partially hollow, for example, having a segmented interior. Therefore, a portion of the hollow member 10 contains devoid or empty space, while the remaining portion of the hollow member 10 is filled, complete or otherwise substantially occupied. Furthermore, the filled, complete or otherwise substantially occupied space in the hollow member 10 can be made of the same material as the casing or tube of the hollow member 10. However, in certain embodiments, the filled, complete or otherwise substantially occupied space of the hollow member 10 includes a material different from the casing or tube of the hollow member 10.

In addition, as shown in FIG. 1A, a plurality of apertures 14 can be disposed substantially diametrical along at least the portion of the length of the hollow member 10. Also, a plurality of apertures 14 can be disposed substantially linearly along at least the portion of the length of the hollow member. As shown in the disclosed embodiment in FIG. 1A, a plurality of apertures 14 can be disposed on one end of the portion of the hollow member 10 with the remainder of the hollow member 10 free of apertures. However, a plurality of apertures 14 can be disposed along the entire length of the hollow member 10.

Also, referring to FIGS. 1A and 1B, a further object of the invention is to provide a target 20 that is coupleable to the flexible line 18 hanging down from the hollow member 10. Also, the disclosed embodiment disclosed in FIGS. 1A and 1B shows a flexible line 18 that includes a frayed portion 22, which is an alternative target for a user. Furthermore, a user can change the height of the target 20 hanging down from the hollow member 10 by merely adjusting the flexible line 18 with the hollow member 10. For example, a user can adjust the length of the flexible line 18 that passes into and out of the hollow member 10 through the plurality of apertures 14 to adjust the height of the target 20 that is coupleable to the flexible line 18.

To assemble, a first end 24 of the flexible line 18 is passed through the target 20 and coupled by a knot that has a diameter or size greater than the diameter or size of the opening of the target 20 through which the flexible line 18 passes. Thereafter, the first end 24 of the flexible line 18 is threaded through the end cap 12, and threaded into and out of the hollow member 10 through at least one of the plurality of apertures 14. The first end 24 of the flexible line 18 can be taped or capped so that a user can pass the flexible line 18 into and out of the apertures easier. The height of the target 20 is regulated by adjusting the flexible line 18 in the hollow member 10.

Figure 1C:
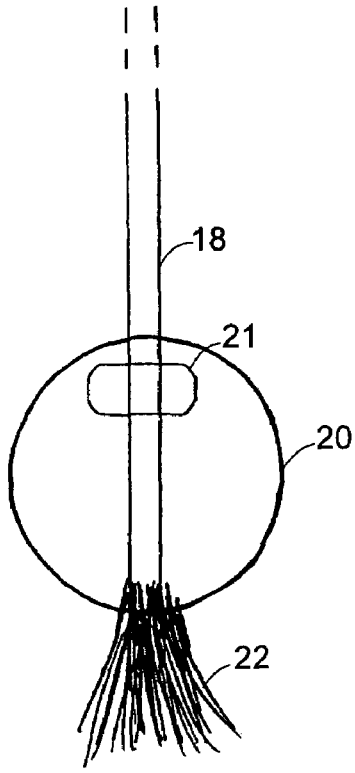
FIG. 1C is a cross-sectional view of an embodiment of the invention that includes a weight coupled to a flexible line.

The invention can also include a weight coupled to the flexible line. The weight can keep the flexible line substantially taut when the flexible line hangs down from a hollow member. The weight can comprise tape, rubber, plastic, metal, or wood. The weight can be a nut, a washer, or a ball bearing. Referring to FIG. 1C, a weight is coupled to the flexible line 18. The disclosed embodiment shows a metal nut 21 that is secured inside a target 20. However, in other embodiments, a weight can be coupled to any location on the flexible line 18. In the disclosed embodiment, the metal nut 21 remains inside the target 20 because the metal nut 21 has a greater size than the holes of the target 20 through which the flexible line 18 passes.

Figure 2A:
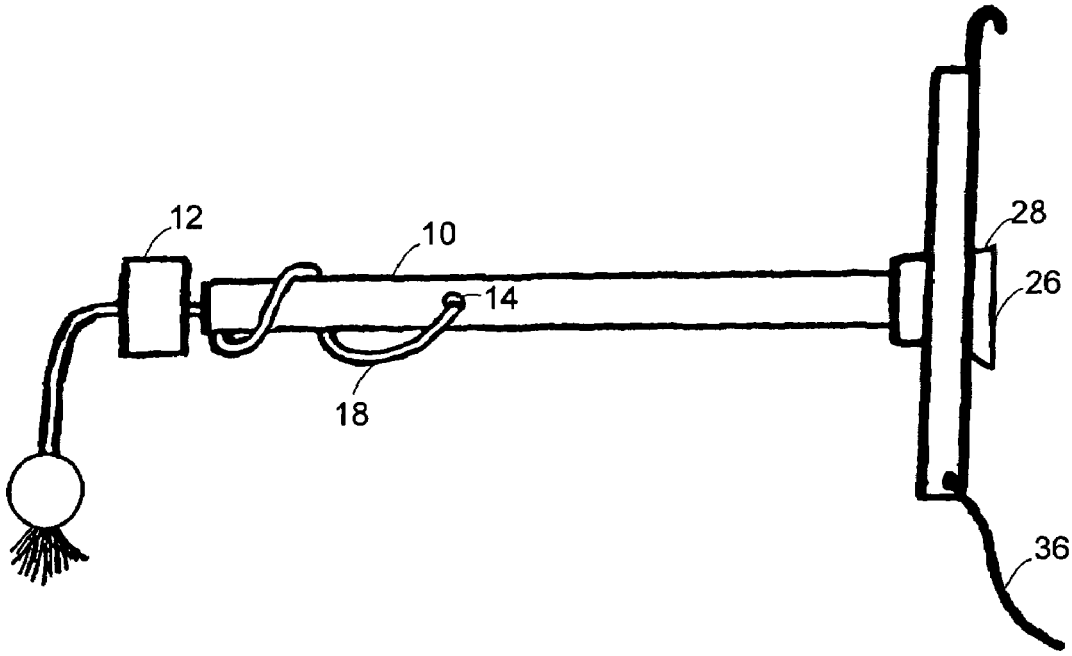
FIG. 2A is a side view of an embodiment of the invention for use with a fence.
Figure 2B:
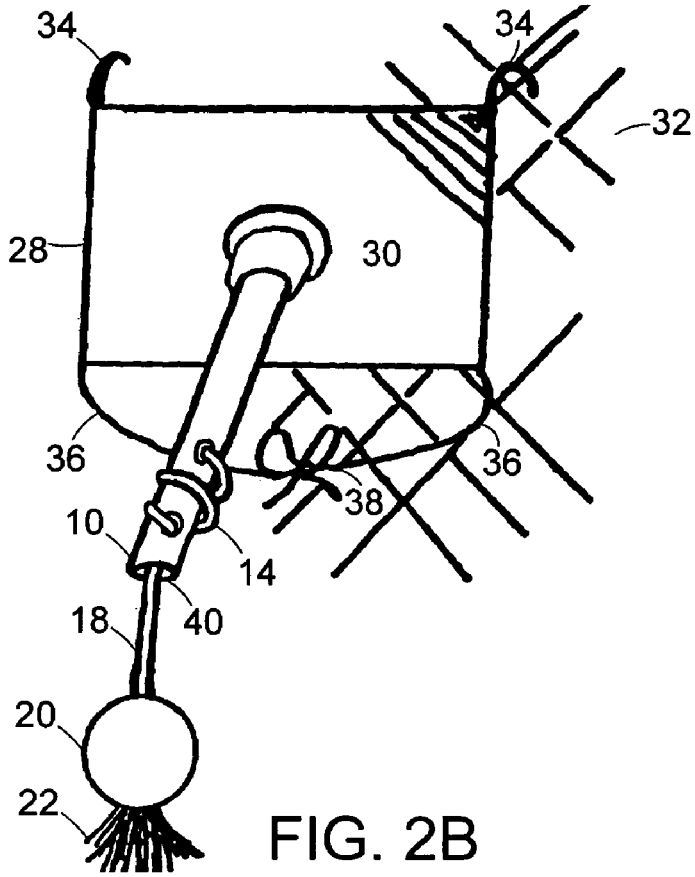
FIG. 2B is a partial front view showing an embodiment of the invention that is coupled to a fence.

The support structure including the hollow member can be designed for use with any means of support, such as a pole, a tree, a fence or a wall. For example, the support structure can used with a fence, such as chain link fence. Referring to FIGS. 2A and 2B, the device includes a vertical base 28 that includes a hollow member 10 and flexible line 18, that can be secured to a fence 32. The device also includes an end cap 12. As shown in the disclosed embodiment, a hollow member 10 is coupleable to a connecting flange 26. The connecting flange 26 is coupleable to a vertical base 28 such that the connecting flange 26 is disposed within the vertical base 28. As shown, for example, in FIGS. 2A, 2B and 2C, the connecting flange 26 is secured to the vertical base 28 by one end that has a diameter greater than the vertical base aperture 30 for inserting the hollow member 10.

Referring to FIGS. 2A and 2B, the vertical base 28 is secured to a chain link fence 32 by a plurality of hooks 34. Also, the vertical base 28 is secured to the fence 32 by a drawstring 36 that is tied together by a slip knot 38, for example. The vertical base 28 can be made of wood, plastic, steel and other material that stabilizes the hollow member 10 to a fence 32. The vertical base 28 can be straight or curved.

Figure 2C:
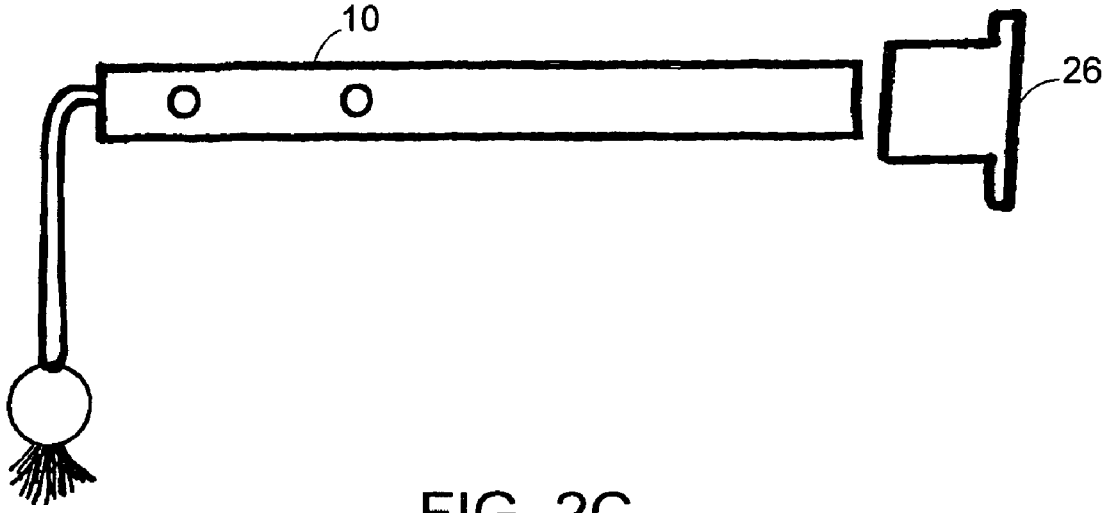
FIG. 2C is an expanded side view of a hollow member and a connecting flange.

Referring to FIGS. 2A, 2B and 2C, a hollow member 10 includes a plurality of apertures 14 disposed along a portion of the length of the hollow member 10. In the disclosed embodiment, the flexible line 18 passes into and out of the hollow member 10 through the plurality of apertures 14 to allow the flexible line 18 to hang down from an open end 40 of the hollow member 10. An end cap 12 is coupled to an end of the hollow member 10. Also, as shown in FIGS. 2A, 2B and 2C, a target 20 is coupled to the flexible line 18. Furthermore, the flexible line includes a frayed portion 22. FIG. 2C shows a hollow member 10 with a connecting flange 26 without the vertical base 28.

To assemble, a connecting flange 26 is disposed in a vertical base 28, and then a hollow member 10 is coupled to the connecting flange 26. Thereafter, the vertical base 28 is attached to a fence 32 by a plurality of hooks 34, and tied to the fence 32 by a plurality of drawstrings 36 using a slip knot 38, for example. The flexible line 18 is passed into and out of the hollow member 10 through the plurality of apertures 15 to allow the flexible line 18 to hang down from the end of the hollow member 10. In the disclosed embodiment, the target 20 is coupled to the flexible line 18. Also, the device includes a frayed portion 22 that serves as an alternative target.

The invention can be designed for use with a vertical object, such as a pole or a tree. For example, a device can be strapped to a vertical pole or tree according to some embodiments of the invention. In this embodiment, a vertical base can be incorporated into a strapping fastener that includes corrugated material. Flexible material, such as corrugated material can be bent or configured to strap around a substantially cylindrical object, such as a pole. The strapping fastener can be secured to a pole by at least one strap that is coupled to the strapping fastener. The straps can secure to a pole using any known means in the art, such as with buckles, buttons, VELCRO brand hook and loop fasteners (available from Velcro USA Inc., Manchester. N.H.), or pins. Also, a plurality of straps can be tied together to secure the strapping fastener to a pole, for example.

Figure 3A:
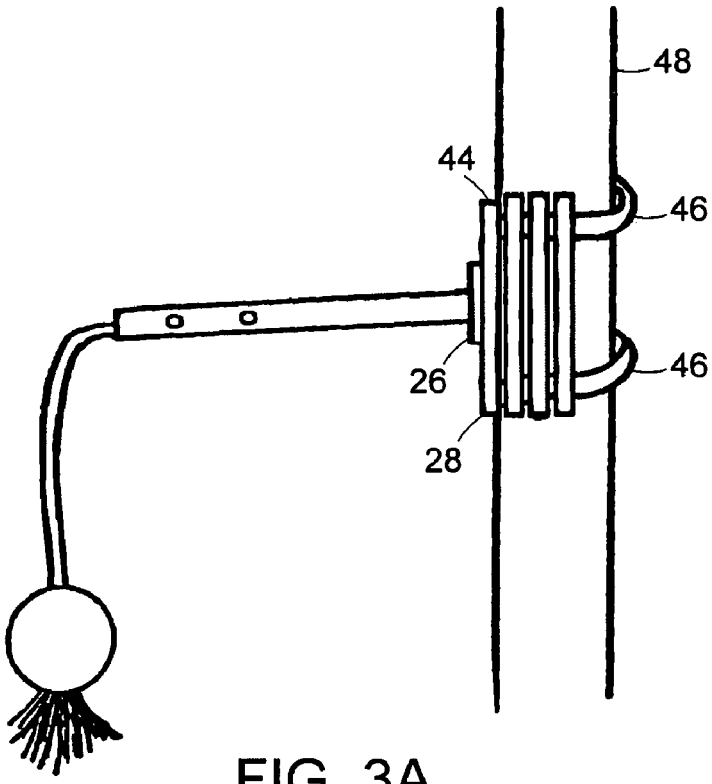
FIG. 3A is a side view of an embodiment of the invention for use with a pole.

Referring to FIG. 3A, a hollow member 10 is coupleable to a connecting flange 26, such that the connecting flange 26 is disposed within the vertical base 28. In embodiments that are to be used with a vertical object that is substantially cylindrical, the vertical base 28 can be arcuate or curved or pliable as appropriate. The connecting flange 26 is secured to the vertical base 28 by one end having a diameter greater than the vertical base aperture.

Figure 3B:
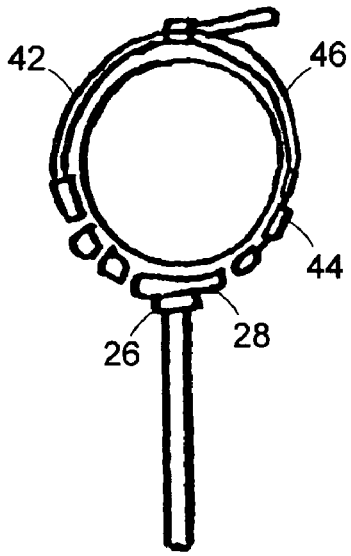
FIG. 3B is a top view of an embodiment of the invention for use with a pole.

In the disclosed embodiment, as shown in FIGS. 3A and 3B, the strapping fastener 42 includes corrugated material 44, such as corrugated plastic. The corrugated material also includes at least one strap 46 to secure the strapping fastener 42 to a pole 48. The strap 46 can a rope, wire or cable, and be made of any suitable material, such as rubber, polyester, cloth, wire, or steel.

To assemble, a connecting flange 26 is disposed in a strapping fastener 42 that includes a vertical base 28, and then a hollow member 10 is coupled to the connecting flange 26, which secures the hollow member 10. Thereafter, the strapping fastener 42 is held to a pole 48 and secured to the pole by at least one strap 46 that is held together.

Figure 4:
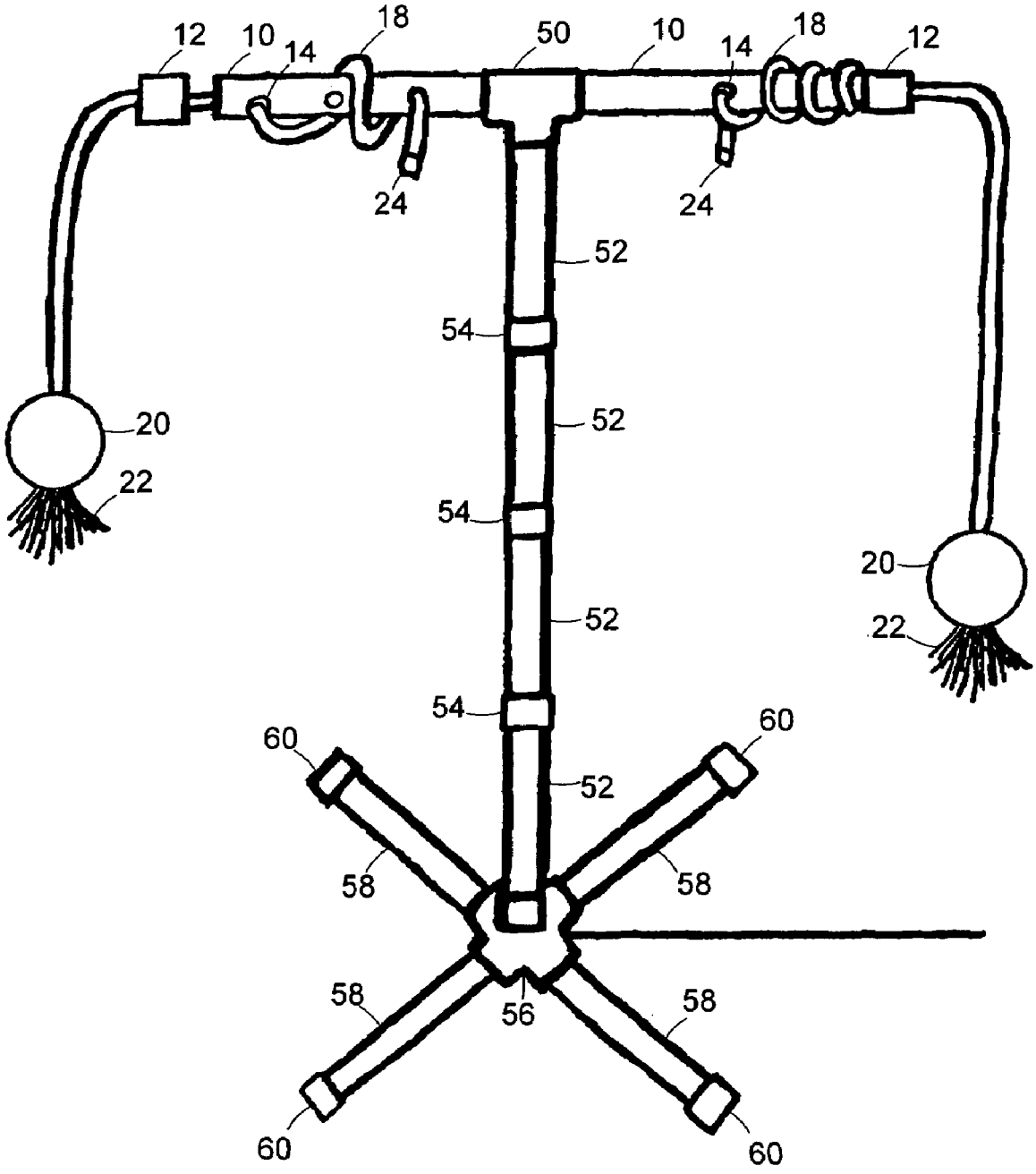
FIG. 4 is a perspective view of an embodiment of a system of the invention including a support structure having a plurality of separable members and a base having a plurality of support members.

The invention also generally relates to a system to improve a user's hand-eye coordination. The system can be placed on the ground or floor. Referring to FIG. 4, a system of the invention includes a hollow member 10 that further includes a plurality of apertures 14 disposed along at least a portion of the length of the hollow member 10. The hollow member 10 also includes an end cap 12. As shown in FIG.

4, the system has two of the hollow members 10, and they are coupled by a male/female connection such as a "T" joint 50. A system according to the invention can include a plurality of hollow members 10 or arms to allow two or more people to practice simultaneously.

The disclosed embodiment includes a system comprising a flexible line 18 that passes into and out of the hollow member 10 through the plurality of apertures 14 to allow the flexible line 18 to hang down from the end cap 12 coupled to the hollow member 10. Also, a target 20 is coupled to the flexible line 18. Also, the flexible line 18 includes a frayed portion 22 that serves as an alternative target.

The system also includes a stand structure coupleable to the hollow member 10 to support the hollow member 10 at a height sufficient to hold the flexible line 18 at a location convenient for the user when the flexible line 18 hangs down from the hollow member 10. In the disclosed embodiment, the stand structure includes a plurality of separable members 52, where at least one of the separable members 52 is coupled to the hollow member 10. A separable member 52 also can be coupled to a "T" joint 50. The stand structure can be coupled to the hollow member 10 by a male/female connection. However, the stand structure also can be a single member, such as a vertical post.

A plurality of separable members can be coupled with coupling connectors. Referring to FIG. 4, a separable member 52 is coupled to another separable member 52 by a coupling connector 54. The separable members 52 can be coupled to coupling connectors 54 by any means known to those skilled in the art. For example, the separable members 52 and the coupling connectors 54 can adjust by a mechanism involving an outer telescoping member and an inner telescoping member. For example, the telescoping members can include a plurality of removable pins that can be inserted into holes formed in either of the telescoping members. Also, for example, the telescoping members can engage in a screw-like fashion, with one of the members having at least one thread for engaging the other member in a screw-like fashion to adjust the height of the stand structure. Furthermore, the height of the stand structure can be adjusted by various means known to those skilled in the art. For example, the telescoping members can include a plurality of removable pins that can be inserted into holes formed in either of the telescoping members. These coupling means, as well as other commonly known means for coupling a more than one component to another can be used for any of the appropriate components according to the invention including, for example, hollow members, end caps, support members, separable members, and other tubular-like elements of the device.

Referring to FIG. 4, the system also includes a base that is coupleable to the stand structure to support the stand structure on a ground or floor. The base is coupled to the stand structure by a male/female connection, such as an "X" joint 56 or other 4 way base part. The disclosed embodiment shown in FIG. 4 has a base that includes a plurality of support members 58, where the support members 58 are coupled to a stand structure or "X" joint 56. Also, the support members also include support member end caps 60.

To assemble, a first end 24 of the flexible line is passed through the target 20 and coupled by a knot that has a diameter greater than the diameter of opening of the target 20 through which the flexible line 18 passes. Thereafter, the first end 24 of the flexible line 18 is threaded through the end cap 12, and threaded into and out of the hollow member 10 through the plurality of apertures 14. The first end 24 of the flexible line 18 can be taped or capped so that passing into and out of the apertures is facilitated. Regulating the flexible line 18 in the hollow member 10 adjusts the height of the target 20.

Also, the stand structure is assembled and coupled to the hollow member 10 to support the hollow member 10 at a height sufficient to dispose the flexible line 18 at a location convenient for the user. The stand structure is assembled by coupling a plurality of separable members 52 and the hollow member 10 to a "T" joint 50. A separable member 52 of the stand structure is coupled to another separable member 52 by a coupling connector 54.

The base is assembled and coupled to the stand structure to provide the appropriate foundation or purchase to the stand structure on a ground or floor. The base is assembled by coupling a plurality of support members 58 and a separable member to an "X" joint 56. Thereafter, the support member end caps 60 is coupled to the ends of each of the support members 58.

The characteristics and configurations of the base also vary depending on the intended use of the device. For example, a lightweight embodiment can include a base that includes a plurality of light weight support members. Also, support members can be of any geometric shape or configuration that provides the base with the necessary foundation or purchase to stabilize the device. For example, the base can be shaped in a "V", "X", or "T" configuration. However, if curved support members are used, the geometries can include, for example, "C", "O", or "U" shaped configurations. Also, in some embodiments, the base can be made of more heavy weight material. For example, the base can include steel, heavy plastics, or can include a hollow member capable of being filled with heavy substances, such as sand or stones. A heavier base provides greater support to stabilize the device when a target is struck.

Figure 5A:
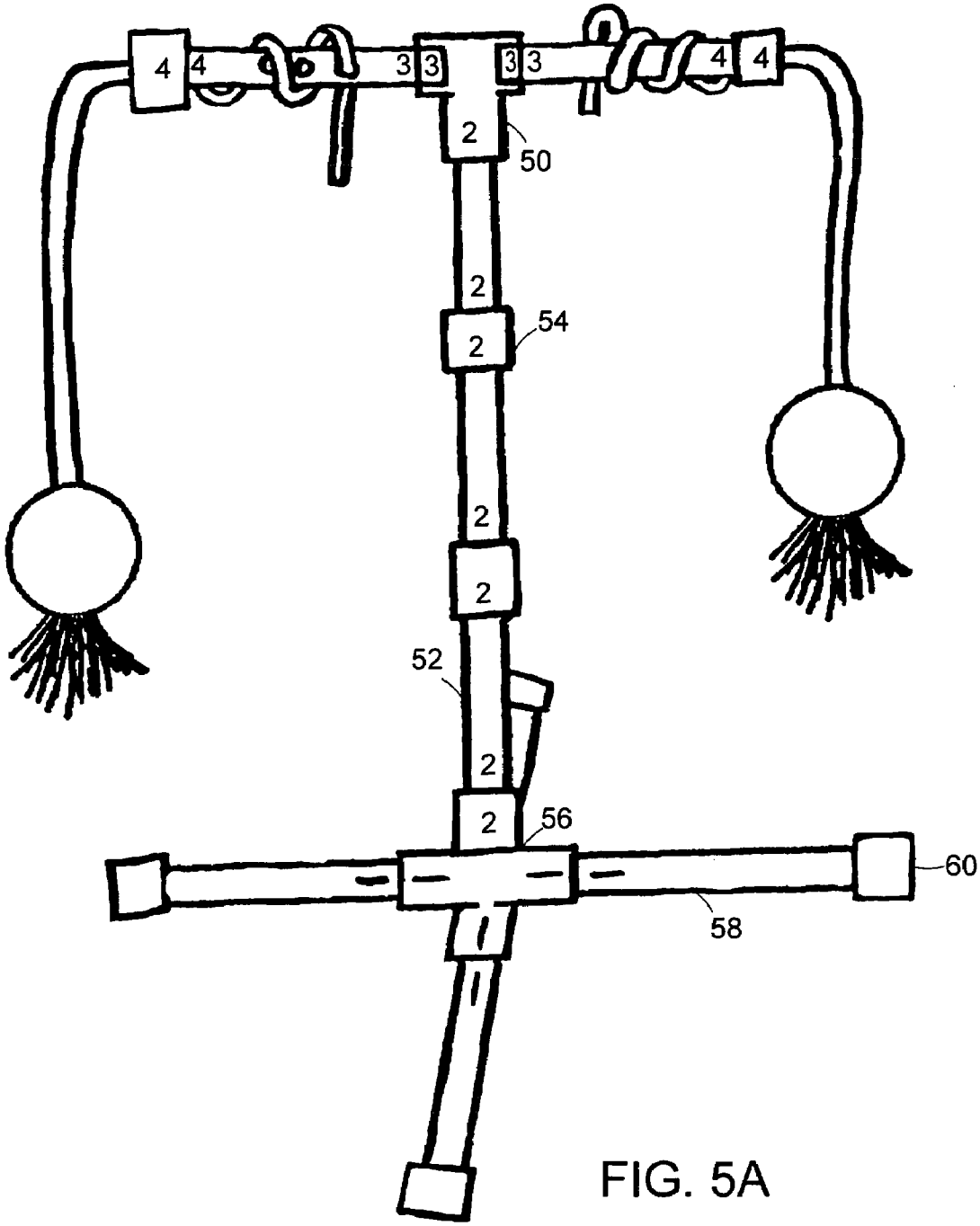
FIG. 5A is a perspective view of a commercial embodiment of the system of the invention including a support structure and a base.

Devices according to the invention can be designed in a lightweight and easy-to-assemble commercial embodiment. Referring to FIG. 5A, a system according to the invention can include labeled components. For example, as exemplified in the disclosed embodiment shown in FIG. 5A: the base including the support members 58 can be labeled with a "1"; the stand structure including the separable members 52 and the coupling connectors 54 can be labeled with a "2"; each end of the hollow member 10 coupleable to the "T" joint 50 and the "T" joint 50 can be labeled with a "3"; and, each end of the hollow member 10 coupleable to the end cap 12 and the end cap 12 can be labeled with a "4". Other labeling techniques can be used to facilitate the easy assembly and disassembly of the system. For example, instead of numerical labels, designs or color coded labeling can be used to associate the components.

Figure 5B:
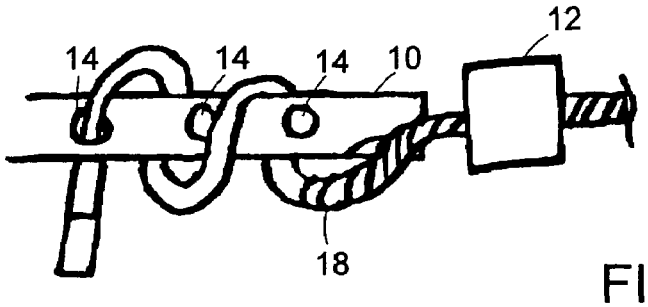
FIG. 5B is an expanded view of a support structure having a flexible line passing through some of the apertures disposed along a portion of a hollow member.

It is not required that a flexible line pass into and out of each aperture disposed along a portion of the length of the hollow member. Rather, one advantage of the invention allows a user to pass the flexible line to at least one aperture disposed along a portion of the length of the hollow member. Referring to FIG. 5B, a hollow member 10 includes a plurality of apertures 14 disposed along at least a portion of the length of the hollow member 10. The hollow member 10 also includes an end cap 12. As shown in the disclosed embodiment, a flexible line 18 passes into and out of the hollow member 10 through at least one of the plurality of apertures 14 to allow the flexible line 18 to hang down from the end cap 12 coupleable to the hollow member 10. Accordingly, it is not necessary for the flexible line 18 to pass into and out of each of the plurality of apertures 14 disposed on the hollow member 10.

Figure 6:
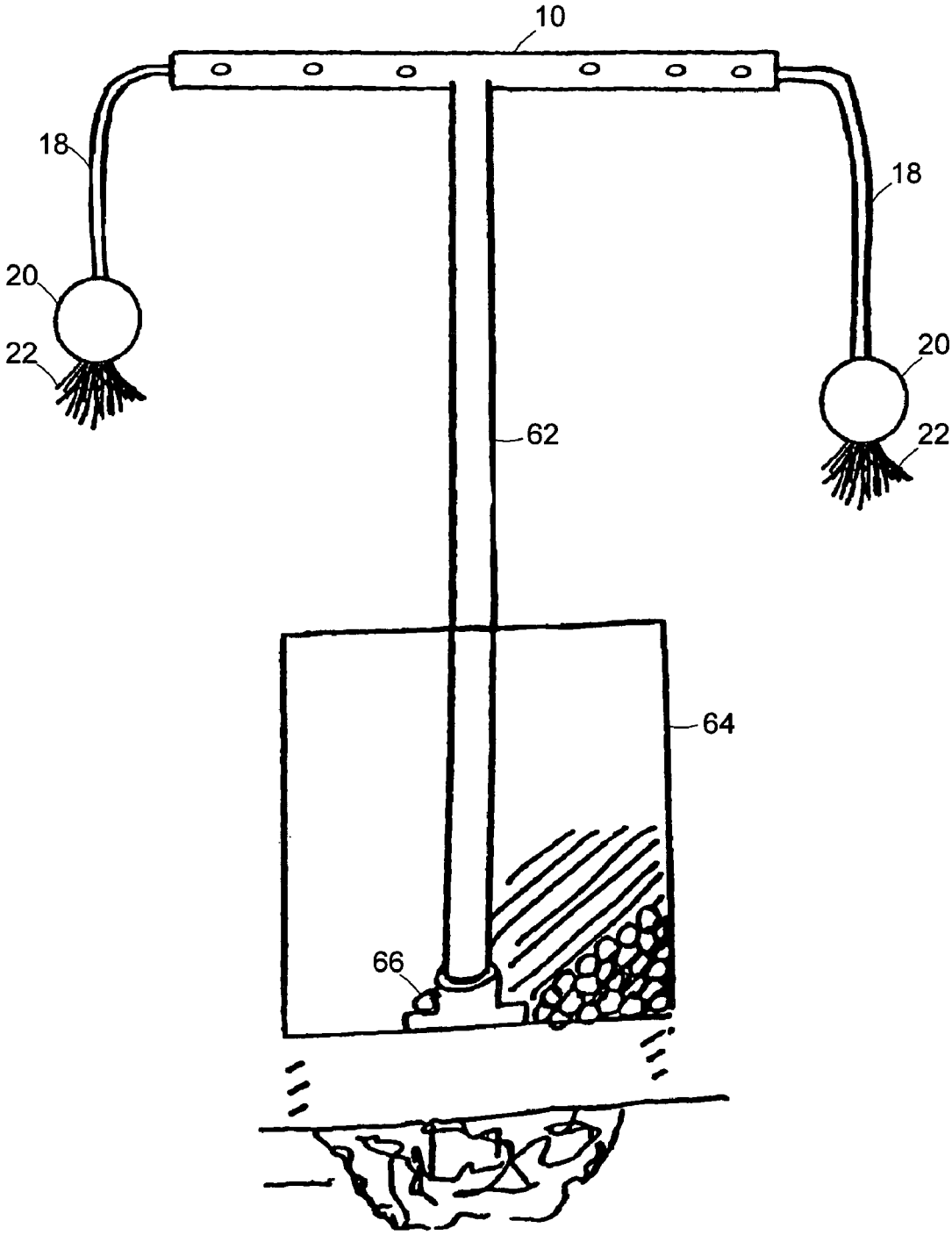
FIG. 6 is a partial cross-sectional view of an embodiment of the invention that includes a filled bucket for substantially fixing the device to a ground.

The invention includes a system to improve a user's hand-eye coordination that is secured to the ground or floor. Referring to FIG. 6, the system includes a hollow member 10 that further includes a plurality of apertures 14 disposed along at least a portion of the length of the hollow member 10. The hollow member 10 also includes two ends from which flexible lines 18 hang down. Also, FIG. 6 shows a target 20 coupled to the flexible line 18. Also, each flexible line 18 can include a frayed portion 22 that serves as an alternate target. The disclosed embodiment, as shown in FIG. 6, includes a vertical member 62 or pole secured to the ground. Although not required, in some embodiments, the vertical member 62 can pass through a bucket 64, such as a 5-gallon bucket filled with water, gravel, concrete or other material to provide additional stability to the device. Although not required, the vertical member 62 also can be coupled to a ground flange 66 and anchored or fixed into the ground.

Figure 7:
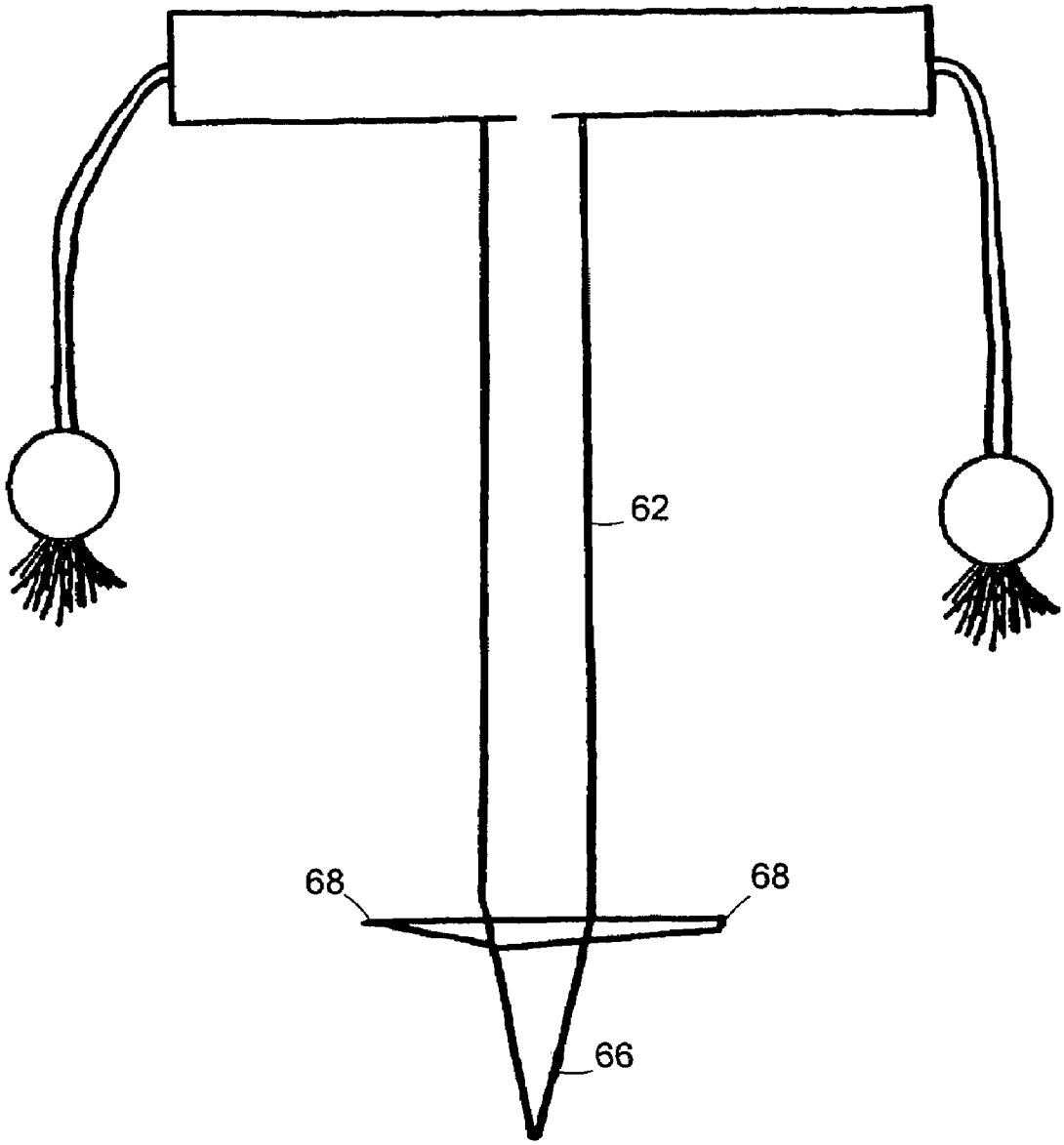
FIG. 7 is a perspective view of an embodiment of the invention designed to be driven into the ground.

The invention includes a shaped end to facilitate securing or driving a device according to the invention to the ground or floor. Referring to FIG. 7, the vertical member 62 can have a point, wedge, or other "V" shaped end 66 to facilitate securing or driving the device into the ground. Also, a step extension 68 is coupleable to the vertical member 62 so that a user can add additional downward force when driving or securing the device into the ground by stepping on the step extension 68.

The invention can be designed for use in windy environments. Referring to FIGS. 8A, 8B, 9A and 9B, the device further includes an attachable member that prevents the flexible line from moving substantially in windy environments.

Figure 8A:
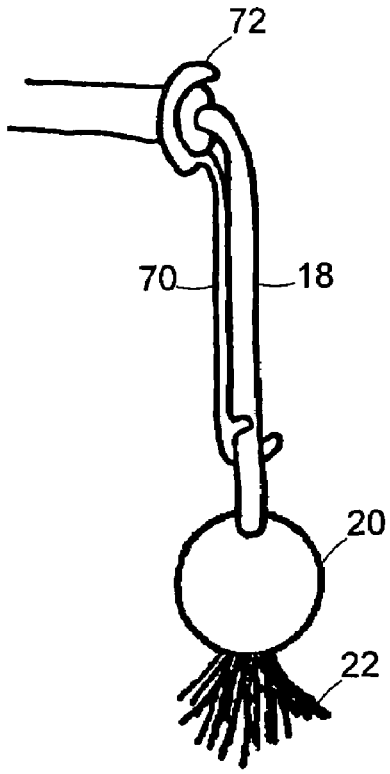
FIG. 8A is a side view of an embodiment of the invention including a clip coupled to a hollow member and holding a flexible line in a resting position.
Figure 8B:
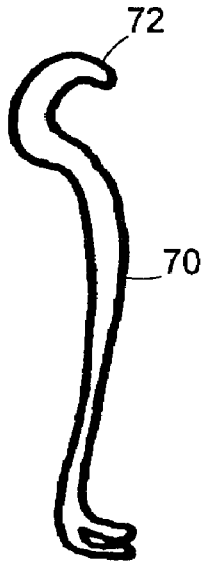
FIG. 8B is a perspective view of a clip.

Referring to FIGS. 8A and 8B, a device according to the invention includes a clip 70 that is attachable to the hollow member 10, which maintains the flexible line 18 in a resting position. The clip 70 includes a curved end 72 that secures to the hollow member 10. As shown in FIG. 8A, the user can hit the frayed portion 22 of the flexible line 18. However, the user can also hit the target 20 which will cause the clip 70 and the flexible line 18 to rotate around the axis of the hollow member 10.

Figure 9A:
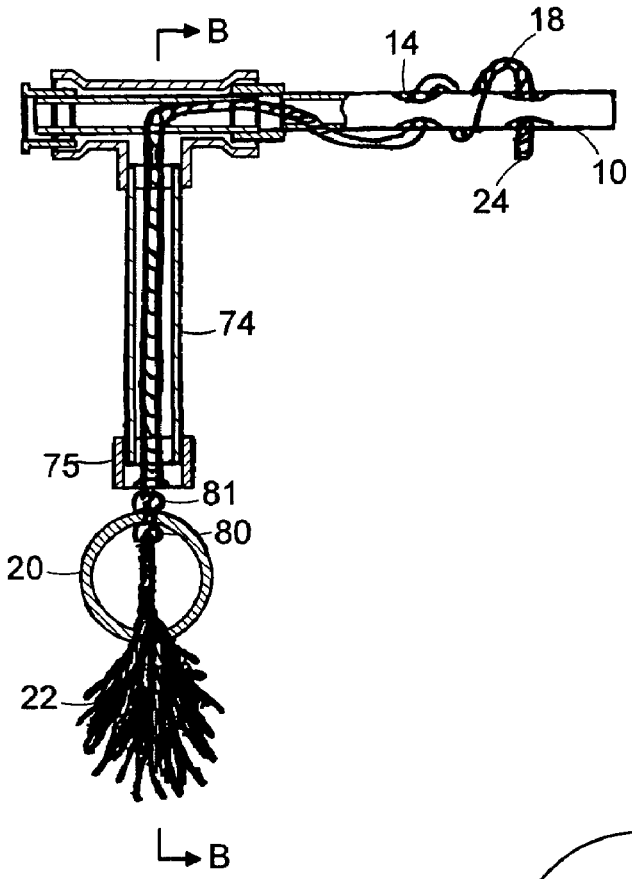
FIG. 9A is a partial cross-sectional view of an embodiment of the invention including a retaining member.
Figure 9B:
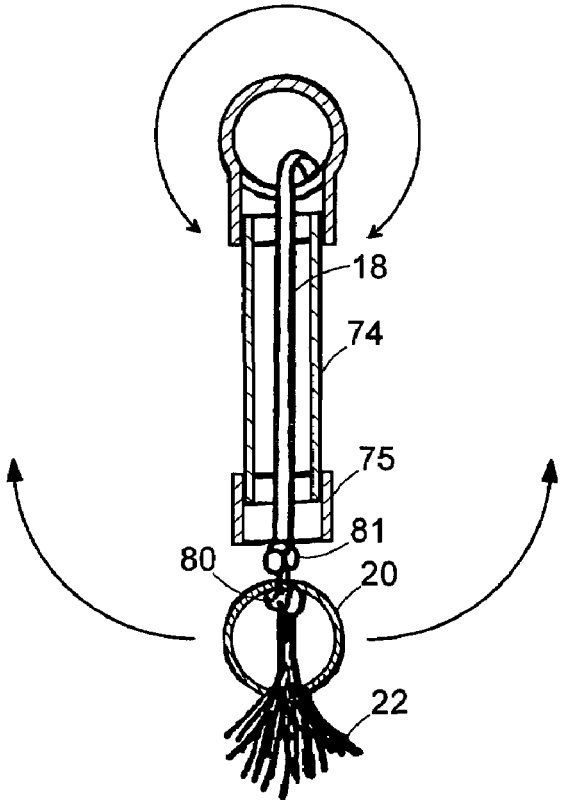
FIG. 9B is an cross-sectional view taken along a line BB of FIG. 9A showing the retaining member rotation around the axis of the hollow member.

Referring to FIGS. 9A and 9B, a device according to the invention includes a retaining member 74 that is coupleable to the hollow member 10, which maintains the flexible line 18 in a resting position. The retaining member 74 has openings on each end that allows it to fit over the hollow member 10. The user can hit the frayed portion 22 of the flexible line 18 or the target 20. Depending on the force used to hit the target 20, the retaining member 74 and the flexible line 18 can rotate partially around the axis of the hollow member 10.

To assemble, a first end 24 of the flexible line is passed through the target 20 and coupled by a knot 80 that has a diameter greater than the diameter of opening of the target 20 through which the flexible line 18 passes. As shown in FIGS. 9A and 9B, a second knot 81 is tied above the target 20 to secure the target 20 at a pre-determined position on the flexible line 18. Thereafter, the first end 24 of the flexible line 18 is threaded through the retaining member end cap 75, and threaded into and out of the hollow member 10 and through the plurality of apertures 14. The first end 24 of the flexible line 18 can be taped or capped so that passing into and out of the apertures is facilitated. Regulating the flexible line 18 in the hollow member 10 adjusts the height of the target 20 (or the alternate target 22).

Typically, embodiments of the invention include targets coupleable to a flexible line that are specifically geared for the skill intended to be practiced. For example, a target can involve a ball (or target that is substantially similar to a ball) that resembles a ball used in regulation game setting. A target can resemble the size of the regulation-sized target, the weight of the regulation-sized target, or both. For example, a regulation-sized baseball or softball can be used for those practicing baseball or softball, respectively. A volleyball can be used as a target for users practicing striking or serving a volleyball. A tennis ball can be used as a target for users practicing a tennis serve and/or a ground stroke. A hockey puck can be used for users practicing hitting a hockey puck. Also, a golf ball can be used for those practicing a golf swing. A target can include any ball, puck, or other object that resembles a target that is used in an regulation game setting.

Figure 10A:
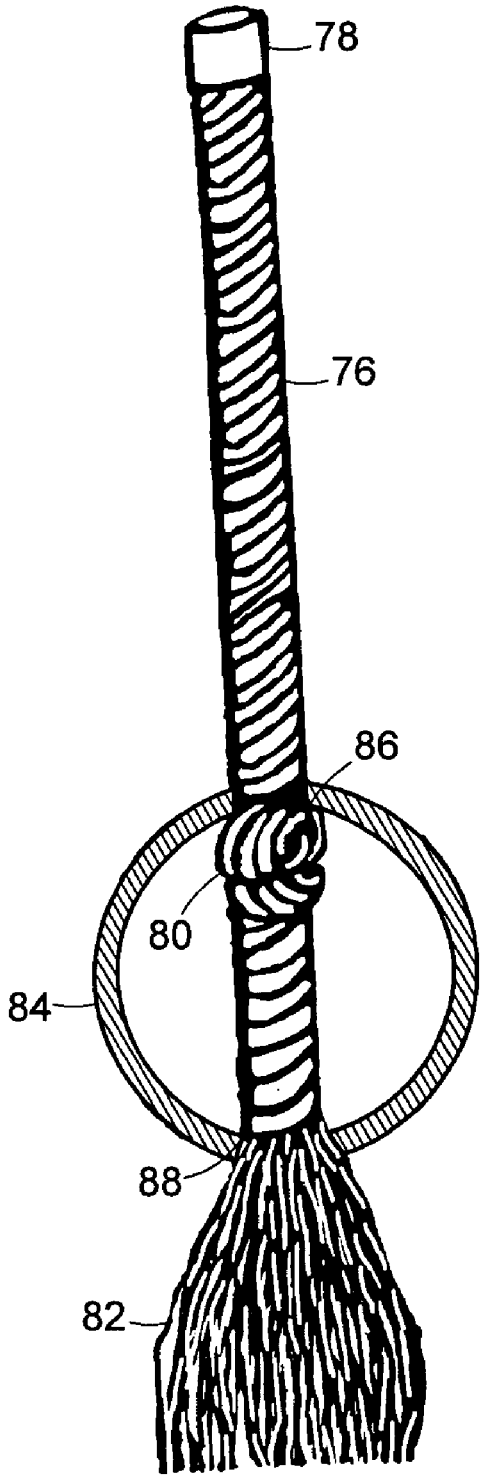
FIG. 10A is a cross-sectional view of a rope and ball embodiment of the invention.
Figure 10B:
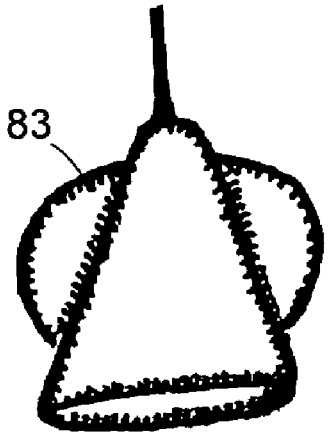
FIG. 10B is a perspective view of a fabric target and a fastening string passing therethrough.
Figure 10C:
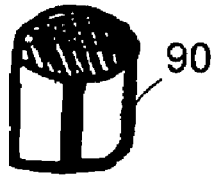
FIG. 10C is a perspective view of a plastic sleeve.
Figure 10D:
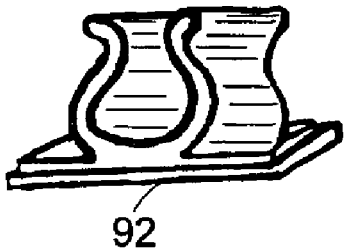
FIG. 10D is a perspective view of a clip.
Figure 10E:
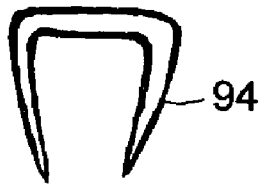
FIG. 10E is a perspective view of a staple.

In some embodiments, as shown in FIG. 10A, a hollow lightweight target can be used instead of an actual target used in game play. For example, a hollow plastic baseball-sized target can serve as a target instead of an actual baseball used in regulation baseball. Some embodiments of the invention include targets that are substantially the same size and shape of a target that is intended to be struck in gameplay. In other embodiments, however, the size and shape of the target can be modified, and in some cases, made smaller to increase the difficulty level of the training or practice. Also, the target can be made of any suitable material, such as, for example, rubber, plastic, latex, cotton, wool, polyester, or other synthetic material.

However, the invention is not limited to targets that include balls used in an organized game or sport, for example. A target can include any object or objects that can be struck by a user. In some embodiments, a target can be modified to be a visually enticing target. For example, a target can include bright colors such as, neon-yellow or neon-orange. However, any color can be used to distinguish a target. Also, the target can be shaped in any form. Furthermore, a target can be scented with a particular odor. Moreover, a target can be enhanced to be more effective in a less-bright setting, and can even be augmented to glow-in-the-dark.

An example of a rope and target embodiment of the invention is provided in FIG. 10A, and described in U.S. patent application Ser. No. 09/260,460, the entire disclosure of which is incorporated by reference herein. One object of the following embodiment is to provide a low cost and lightweight striking target to improve hand-eye coordination. Although the following exemplary device provides a flexible line that is a rope, the invention includes any material that could be used as a flexible line, such as any braidable fiber or wire, or other lines made of metal, plastic, rubber, synthetic or neutral materials.

Referring to FIG. 10A, the rope and target embodiment enables the user to practice batting, punching, and kicking techniques anywhere without effecting the environment around them. As shown in the disclosed embodiment, a suspended striking device includes: (a) a light weight length of material that supports a target/striking area; (b) a mounting system that is quick and easy to install to any surface, (c) a striking target that is soft and effects the least amount of resistance when struck; and, (d) a striking apparatus that does not make any noise when struck with a fist, foot, bat or club.

The rope and target embodiment of FIG. 10A includes a target that further includes a hole through which the rope passes. To manufacture the disclosed rope and target embodiment of FIG. 10A, a length of rope 76 is chosen. The length of the rope 76 is cut, and tape 78 or seal is affixed to the end of the rope 76 to prevent separation of fibers. At the opposite end, the rope 76 is knotted about 4" or more from that end. Below the knot 80 the rope 76 is separated to produce a frayed target 82 and/or a piece of fabric or fabric target 83 can be mounted to the end of the rope 76 to create target area. When the frayed target 82 is struck the device will remain substantially still and produce very little or no noise. In the disclosed embodiment of FIG. 10A, the total weight of the device is less then a pound.

According to the invention, a weight coupled to the flexible line keeps the flexible line substantially taut when the flexible line hangs down from the hollow member in a resting position. The weight also can be inside a hollow or partially hollow target. For example, a metal nut can be coupled to a flexible line and inside a target, such as a ball. The weight can include tape, rubber, plastic, metal, or wood. However, one skilled in the art readily understands that any material or combination of materials can be used to keep the flexible line substantially taut when the flexible line hangs down from the hollow member in a resting position. Also in some embodiments of the invention, the weight can be a specific object, such as, for example, a nut, a washer, a ball, a puck, or a ball bearing.

In addition to keeping the flexible line substantially taut when the flexible line hangs down from the hollow member in the resting position, after the target is struck, the weight facilitates the rotation of the flexible line around the axis of the hollow member. In a preferred embodiment of the invention, the target rotates once around the axis of the hollow member before returning to the resting position. However, the target can rotate at least once around the axis of the hollow member before returning to the resting position. Also, the target can move when struck without making a full rotation around the axis of the hollow member before returning to the resting position.

Referring again to FIG. 10A, a weight can be attached just above the knot 80 and serves to stabilize the device when the frayed target 82 is struck. For example, a metal nut encased in a light-weight plastic ball can serve as an appropriate stabilizer. However, as shown in the disclosed embodiment, the visual target or ball 84 can be a weight. In some embodiments, the ball 84 or weight is not intended to be the target, however it can be struck to effect movement of rope 76.

Referring to FIG. 10A, to attach the ball 84 to the rope 76 the thickness of rope 76 being used is determined. A preferred embodiment of the invention includes a ⅜" braided polyester rope 76. For a ⅜" rope 76 a ½" proximal hole 86 is bored through the top end of the ball 84 to allow for the taped end of the rope 76 to pass through. Next, a ¾" distal hole 88 is bored through the ball 84 to allow the knot 80 to pass into the ball 84. With the two holes 86 and 88 bored into the ball 84, then the rope 76 is threaded through the ball 84. To do so one must start with the taped end, threading it through the ¾" distal hole 88 and then the ½" proximal hole 86. Next, the rope 76 is passed through the ball 84 and a knot 80 is thread through the ¾" distal hole 88 until the knot 80 is encased within the ball 84. The smaller proximal hole 86 prevents the knot 80 from passing through the ball 84, thus keeping the ball 84 in place. The frayed target 82 or puff of rope fiber or fabric seats under the ball 84 and forms the target area, which is the striking point.

Referring to FIGS. 10B–10E, at the taped end (top) a plastic sleeve 90 is fastened to the rope 76. The plastic sleeve 90 serves two purposes. First, the plastic sleeves acts as a height indicator for the user. Second, the plastic sleeve 90 provides for the quick connection and release of the rope 76 when using a clip 92, such as a plastic cord clip.

The device also can be attached to surfaces using a number of other techniques. As discussed above, a clip 92, such as a cord clip is used to attach to smooth surfaces. A cable staple 94 is used to attach to both smooth and rough surfaces, such as wood and plaster. In other embodiments, a suction cup, a nail or tape can be used to attach to various surfaces. These attachment means can include an adhesive backing to facilitate attaching to a surface. Preferred embodiments of the attaching the device to a surface include the use of a cord clip or cable stable.

The components of the device can be made from any material that is suitable for the intended use of the device. For example, the invention can include lightweight material such as, plastics and other lightweight material known to those skilled in the art. Exemplary materials for components of the device include high-impact plastic resins, such as polyvinylchloride, polyethylene, polypropylene, PVC pipe, other plastics, and other materials that do not easily shatter or damage if accidentally struck. However, components of the device can be manufactured from other suitable material such as rubber, metal, wood, composite materials, or any combination thereof, to produce the appropriate device for the intended use.

One benefit of having lightweight components is that a user can carry the invention to various locations with ease. Accordingly, each of the components of the invention can be placed inside of a backpack, for example, for lightweight transport. A user can disassemble the invention into each of the individual components and transport the device from one location to another location for reassembling, and vice versa. However, the device can be made of durable materials that are more permanent and less conducive for transport. Such devices can be used in a more defined setting, such as a university or high school gym or a ballpark during spring training of baseball, for example.

As described herein, a flexible line also can be light weight. Examples of light weight material for a flexible line include nylon, polyester or rubber. On the other hand, the invention can be manufactured with stronger, more durable material such as heavy plastics, cable, wire, wood or metal. More durable material is advantageous if the use is more frequent, for example, when used by individuals on a sports team. The more durable materials are less likely to deteriorate after repeated uses. Also, a device can include a mixture of lightweight and more durable materials that are appropriate for the intended use of the invention.

Devices according to the invention can be modified in order to be made suitable for its intended use. For example, without limitation, the device can be used to practice baseball, softball, tennis, volleyball, hockey, golf, and any other sports that require hand-eye coordination. For example, a baseball practice device can be designed to be about two to about six feet tall. However, a golf device can be designed to be about six inches to about one foot tall.

Furthermore, in some embodiments, devices do not make any or very little noise when struck. For example, in these embodiments, a user can strike the frayed portion of the flexible line. One advantage to these devices is that these embodiments result in the least amount of resistance when the target is struck. Another advantage of these devices is that they can be installed easily anywhere and adjusted for height with ease by a user of any skill level, including children. Also, the devices can be struck without fear of bodily injury. Furthermore, the device increases hand-eye coordination for the user, and promotes physical fitness.

Also, another advantage of devices according to the invention is that children can practice (e.g., practice their baseball batting swings) anywhere without the need for another person to be present. Furthermore, users can learn to defend themselves by practicing their punching and kicking techniques in an apartment or office without disturbing anyone.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

The invention claimed is:

1. A system for improving a user's hand-eye coordination, the system comprising:

a hollow member comprising a plurality of apertures disposed along at least a portion of a length of said hollow member, said hollow member further including an end aperture positioned at an end of said hollow member for securing a flexible line;

a flexible line, said flexible line for threading into and out of said hollow member through at least some of said plurality of apertures, said flexible line also passing through said end aperture for allowing said flexible line to hang down from said hollow member;

a stand structure coupled to said hollow member to support said hollow member at a height sufficient to dispose said flexible line at a location above a ground surface;

a first target coupled to said flexible line at a height above said ground surface, wherein a user can strike said first target to improve said user's hand-eye coordination; wherein said flexible line passes through a hole in said first target;

a weight coupled to said flexible line; and a second target, said second target being formed from a frayed portion of said flexible line at a location below said first target; wherein said frayed portion is of substantial length for serving as an alternate target.

2. The system of claim 1 wherein the hollow member further comprises an end cap that includes an end aperture and that is coupled to an end of the hollow member.

3. The system of claim 1 wherein the first target comprises a ball.

4. The system of claim 3 wherein the ball includes a hole through which the flexible line passes.

5. The system of claim 1 wherein the weight keep the flexible line substantially taut when the flexible line hangs down from the hollow member in a resting position.

6. The system of claim 1 wherein the flexible line is a rope, a cable, a string, a cord or a wire.

7. The system of claim 1 wherein the weight comprises tape, rubber, plastic, metal, or wood.

8. The system of claim 1 wherein the weight is a nut, washer, or ball bearing.

9. The system of claim 1 wherein the stand structure comprises a plurality of separable members, at least one of the separable members being coupled to the hollow member.

10. The system of claim 1 wherein the stand structure is coupled to the hollow member by a male/female connection.

11. The system of claim 1 further comprising a base that is coupled to the stand structure.

12. The system of claim 11 wherein the base is coupled to the stand structure by a male/female connection.

13. The system of claim 11 wherein the base comprises a plurality of support members.

14. The system of claim 13 wherein each of the support members is cylindrical.

15. The system of claim 13 wherein at least one of the support members is coupled to the stand structure by a male/female connection.

16. The system of claim 1 wherein the first and second targets move when struck by an object wielded by a user, and the object is a bat, a racket or a club.

17. A system for improving a user's hand-eye coordination, the system comprising:

a hollow member comprising a plurality of apertures disposed along at least a portion of a length of said hollow member, said hollow member further including an end aperture positioned at an end of said hollow member for securing a flexible line;

a flexible line, said flexible line for threading into and out of said hollow member through at least some of said plurality of apertures, said flexible line also passing through said end aperture for allowing said flexible line to hang down from said hollow member;

a stand structure coupled to said hollow member to support said hollow member at a height sufficient to dispose said flexible line at a location above a ground surface;

a first target coupled to said flexible line at a height about said ground surface, wherein a user can strike said first target to improve said user's hand-eye coordination; wherein said flexible line passes through a hole in said first target; and wherein the first target comprises a ball a weight positioned on said flexible line; and a second target, said second target being formed from a frayed portion of said flexible line at a location below said first target; wherein said frayed portion is of substantial length for serving as an alternate target.

18. The system of claim 17 wherein the hollow member further comprises an end cap that includes an end aperture and that is coupled to an end of the hollow member.

19. The system of claim 17 wherein the weight keeps the flexible line substantially taut when the flexible line hangs down from the hollow member in a resting position.

20. The system of claim 19 wherein the weight comprises tape, rubber, plastic, metal or wood.

21. The system of claim 17 wherein the first and second targets move when struck by an object wielded by the user.

22. The system of claim 17 wherein the stand structure comprises a plurality of separable members, at least one of the separable members being coupled to the hollow member.

23. The system of claim 17 wherein the stand structure is coupled to the hollow member by a male/female connection.

24. The system of claim 17 further comprising a base that is coupled to the stand structure.

25. The system of claim 24 wherein the base is coupled to the stand structure by a male/female connection.

26. The system of claim 17 wherein the base comprises a plurality of support members.

27. The system of claim 26 wherein each of the support members is cylindrical.

28. The system of claim 26 wherein at least one of the support members is coupled to the stand structure by a male/female connection.

* * * * *